US011957950B2

(12) United States Patent
Ganz et al.

(10) Patent No.: US 11,957,950 B2
(45) Date of Patent: Apr. 16, 2024

(54) WEIGHT GLOVE CLAMP

(71) Applicants: Jeremy Abel Ganz, Fort Eustis, VA (US); Robert Newton Rountree, Cody, WY (US)

(72) Inventors: Jeremy Abel Ganz, Fort Eustis, VA (US); Robert Newton Rountree, Cody, WY (US)

( * ) Notice: Subject to any disclaimer, the term of this patent is extended or adjusted under 35 U.S.C. 154(b) by 0 days.

(21) Appl. No.: 18/227,820

(22) Filed: Jul. 28, 2023

(65) Prior Publication Data

US 2024/0082624 A1 Mar. 14, 2024

Related U.S. Application Data

(60) Provisional application No. 63/405,595, filed on Sep. 12, 2022.

(51) Int. Cl.

| | |
|---|---|
| ***A63B 21/00*** | (2006.01) |
| ***A63B 21/072*** | (2006.01) |
| *A41D 19/00* | (2006.01) |

(52) U.S. Cl.

CPC ..... *A63B 21/4019* (2015.10); *A63B 21/072* (2013.01); *A41D 19/0037* (2013.01)

(58) Field of Classification Search

CPC ..... A63B 21/072; A63B 21/4019

See application file for complete search history.

(56) References Cited

U.S. PATENT DOCUMENTS

| | | | | |
|---|---|---|---|---|
| 3,541,990 | A * | 11/1970 | Du Mas | B63B 34/63 482/106 |
| 4,484,740 | A * | 11/1984 | Green | A63B 21/4021 482/108 |
| 4,487,412 | A | 12/1984 | Meeko | |
| 4,684,122 | A * | 8/1987 | Desmond | A63B 21/4025 482/139 |
| 4,807,876 | A * | 2/1989 | Lothar | B63B 34/63 482/106 |
| 4,936,571 | A | 6/1990 | Buhr | |
| 5,004,231 | A | 4/1991 | Alread | |
| 5,182,814 | A * | 2/1993 | Christensen | A41D 19/01547 2/161.1 |
| 5,324,244 | A | 6/1994 | Miller et al. | |
| 5,435,013 | A | 7/1995 | Davis | |
| 5,468,200 | A | 11/1995 | Hoffman | |
| 5,634,213 | A | 6/1997 | Grover | |
| 5,813,950 | A | 9/1998 | Parker | |
| 5,888,180 | A | 3/1999 | Dewberry | |
| 5,997,494 | A | 12/1999 | Watkins et al. | |
| 6,183,400 | B1 * | 2/2001 | Pope | A63B 21/4019 74/551.8 |
| 6,553,574 | B1 | 4/2003 | Hall et al. | |
| 6,849,036 | B2 * | 2/2005 | Forslid | A63B 21/4021 482/139 |
| 7,008,355 | B2 | 3/2006 | Emick | |

(Continued)

*Primary Examiner* — Joshua Lee

(74) *Attorney, Agent, or Firm* — Robert N. Rountree

(57) ABSTRACT

An apparatus to facilitate weight lifting exercises is disclosed. The apparatus includes a palm plate having a hook portion configured to receive a weight bar. A detent is rotationally connected to the palm plate and configured to constrain the weight bar within the hook member in a closed position. An optional thumb lever may be connected to the detent to facilitate opening and closing the detent.

17 Claims, 7 Drawing Sheets

(56) References Cited

U.S. PATENT DOCUMENTS

| | | | | |
|---|---|---|---|---|
| 7,946,967 | B2 * | 5/2011 | Berhanu | A63B 23/03508 482/109 |
| 8,267,844 | B2 * | 9/2012 | Kassel | A63B 21/4019 482/49 |
| 8,888,152 | B1 * | 11/2014 | Coakley | B25B 9/00 224/267 |
| 9,017,232 | B2 * | 4/2015 | Olivarez | A63B 21/4021 482/106 |
| D813,960 | S * | 3/2018 | Boruch | D21/684 |
| 9,999,266 | B2 * | 6/2018 | Harris | A63B 21/065 |
| 10,004,970 | B1 * | 6/2018 | Mailander | A63B 21/4035 |
| 10,124,238 | B2 | 11/2018 | McCrane | |
| 10,486,011 | B2 * | 11/2019 | McGuire | A63B 1/00 |
| 11,383,123 | B2 * | 7/2022 | Reibman | A63B 21/0724 |
| 2014/0057762 | A1 * | 2/2014 | Olivarez | A63B 71/0054 482/106 |
| 2017/0361184 | A1 * | 12/2017 | Roy | A63B 60/00 |
| 2018/0213864 | A1 | 8/2018 | Parker | |
| 2020/0406120 | A1 | 12/2020 | Bawab | |

* cited by examiner

FIG. 2A
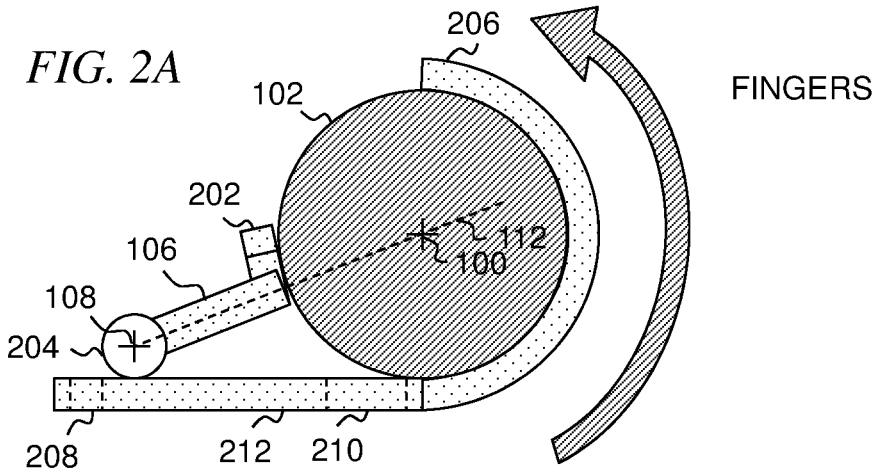
FIG. 2B
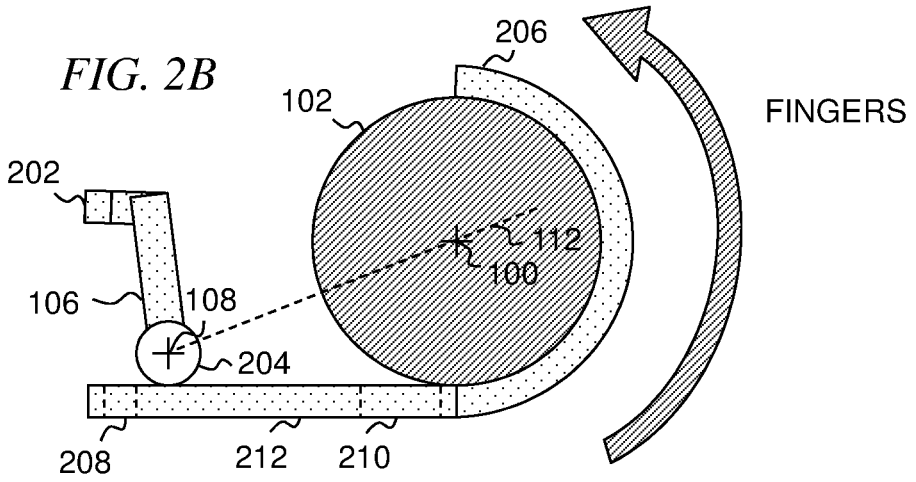
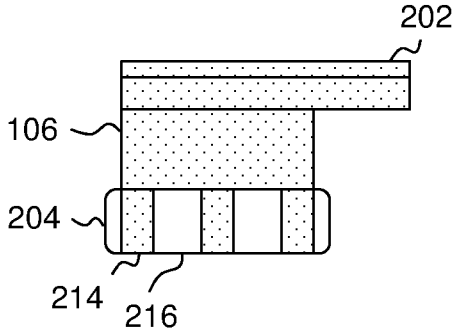
FIG. 2C

WEIGHT GLOVE CLAMP

BACKGROUND OF THE APPLICATION

There are many types of devices to assist in weight lifting exercises. This is because many of the exercises are directed to specific muscle groups in arms and legs and require a user to grasp a barbell or dumbbell with fingers and thumb. Consequently, a weight limitation of an exercise may be determined by fatigue of the fingers or thumb rather than the exercise muscle group. The problem is further exacerbated by a variety of user conditions such as arthritis or previous injury to the hands.

Weight lifting exercises require various orientations of a user hand with respect to a weight bar. A first orientation is with fingers curled around and below the weight bar as a starting position of a dead lift or military press. In this orientation the fingers bear the entire weight. Typical hook and wrist strap designs as disclosed by Christensen in U.S. Pat. No. 5,182,814 or by Emick in U.S. Pat. No. 7,008,355 work well for this orientation but do not assist the user in other exercises. A second orientation is with palm down, fingers curled around the weight bar, and arms extended. This position is encountered in the military press and in fly exercises with dumbbells and fingers and thumb bear the entire weight. A strap device as disclosed by Davis in U.S. Pat. No. 5,435,013 or Alread in U.S. Pat. No. 5,004,231 may assist the user in this orientation. A third orientation with palm up and arms extended is encountered in a curl exercise. Here, the palm and fingers support the entire weight. A fourth orientation with palms forward and arms extended upward occurs at a top of a bench press or military press. Here, the palm and thumb support the entire weight. Of course, there are also intermediate orientations for these four orientations. For example, a military press starts at the first orientation, then goes to the second orientation, and finally to the fourth orientation.

In general, weight gloves and clamps designed for the first orientation offer no benefit for the other three orientations. Likewise, weight straps designed for the second orientation offer little benefit for the other three orientations. Various weight gloves improve a user's grip for the third and fourth orientations but do not relieve the load on fingers and thumb in any orientation. In view of the foregoing problems, embodiments of the present invention are directed to more efficient embodiments of weight glove clamps suitable for multiple exercises.

BRIEF SUMMARY OF THE INVENTION

In a first embodiment of the present invention, a weight lifting apparatus is disclosed. The apparatus includes a palm plate connected to a hook member configured to receive a weight bar. A detent is rotationally connected to the palm plate and configured to constrain the weight bar within the hook member in a closed position.

In a second embodiment of the present invention, a weight lifting apparatus is disclosed. The apparatus includes a palm plate connected to a hook member configured to receive a weight bar. An adjustable detent is rotationally connected to the palm plate and configured to constrain the weight bar within the hook member in a closed position.

In a third embodiment of the present invention, a weight lifting apparatus is disclosed. The apparatus includes a palm plate connected to a hook member configured to receive a weight bar. A detent is connected to the palm plate and configured to rotate in a plane parallel to the palm plate to constrain the weight bar within the hook member in a closed position.

BRIEF DESCRIPTION OF THE SEVERAL VIEWS OF THE DRAWING

FIG. 2A is a side view of a first embodiment of a weight glove clamp of the present invention in a closed position;

FIG. 2B is a side view of the embodiment of FIG. 2A in an open position;

FIG. 2C is a top view of the detent and hinge of FIG. 2A;

DETAILED DESCRIPTION OF THE INVENTION

Figure 1A:
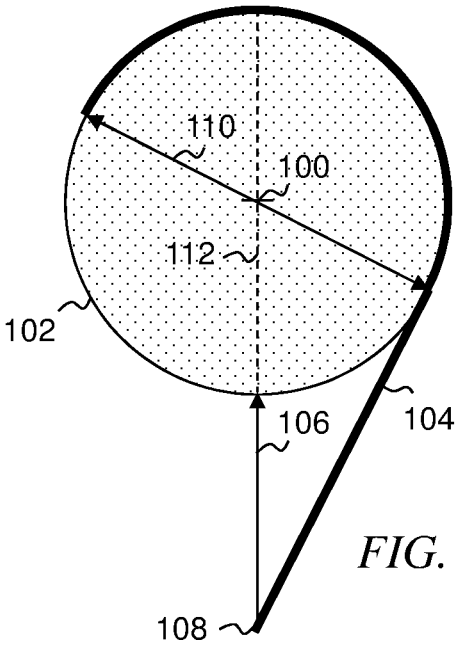
FIG. 1A is a schematic diagram showing loading of a weight glove clamp of the present invention.

Embodiments of the present invention provide significant advantages over weight lifting devices of the prior art as will become evident from the following detailed description. In the following detailed description, the same reference numerals in the various drawing figures refer to substantially the same elements.

Referring to FIG. 1A, there is a schematic diagram showing loading of a weight glove clamp of the present invention. The diagram shows an outline of a palm plate and hook member 104. The curved hook member is configured to receive a round weight bar 102 having a diameter 110. Although the hook member outline is configured as a semicircle in this embodiment, it might alternatively be configured as a triangle, square, or arbitrary geometric design to constrain weight bar 102. The diameter of weight bar 102 may be approximately 29 millimeters (mm) for an Olympic barbell. Alternatively, the bar may have a diameter up to 35 mm for a dumbbell. In either case, the center of the hook member or weight bar 100 is directly above rotational point 108. A neutral line 112 extends from rotational point 108 perpendicular to and through the center of the weight bar. A first end of detent 106 is attached to rotational point 108. A second end of detent 106 contacts the edge of weight bar 102 at a point along neutral line 112. Here and in other embodiments of the instant application, the detent is situated in a closed position between the rotational point and the weight bar. In this orientation substantially all the weight of weight bar 102 is transferred to rotational point 108 via detent 106, and the weight bar exerts no lateral force on detent 106.

Figure 1B:
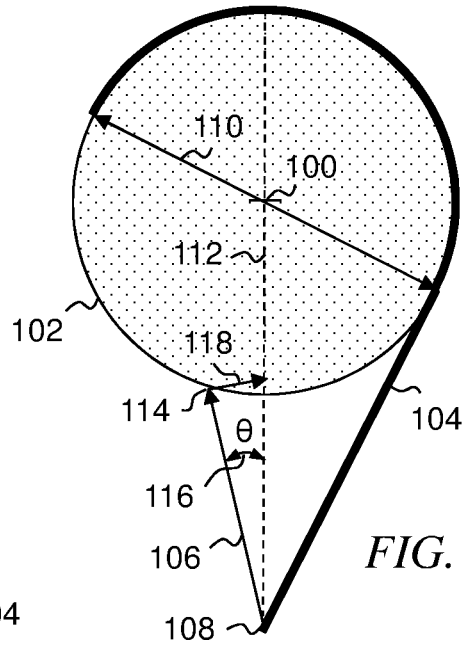
FIG. 1B is a schematic diagram of the weight glove clamp of FIG. 1A with a different detent orientation.

FIG. 1B is the same as FIG. 1A except the second end of detent 106 contacts the edge of weight bar 102 at a point displaced away from neutral line 112 and opposite palm plate 104 by angle θ 116. In this configuration weight bar 102 exerts a lateral force on detent 106 and requires a user to exert opposing lateral force 118 to constrain weight bar 102 within the palm plate and hook member 104. For a small angle θ less than 20 degrees this lateral force is approximately W sin(θ), and the force applied to rotational point 108 is approximately W cos(θ), where W is the weight of weight bar 102. For example, if W is 45 pounds a lateral force of 4.5 pounds or 10% of W must be applied when 0 is 5.7 degrees. A force of 44.8 pounds is then applied to rotational point 108 via detent 106. Likewise, a lateral force of 9.0 pounds or 20% of W must be applied when 0 is 11.5 degrees. A force of 44.1 pounds is then applied to rotational point 108 via detent 106. This configuration is highly advantageous, because a small lateral force applied to detent 106 by a user will firmly constrain bar 102 within palm plate and hook member 104.

Figure 1C:
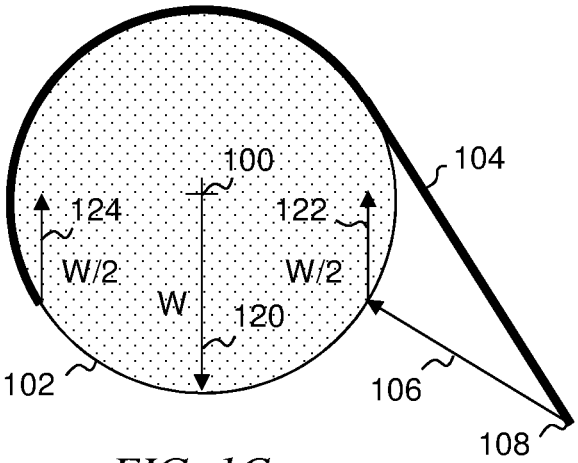
FIG. 1C is a schematic diagram of the weight glove clamp of FIG. 1A showing loading in a different clamp orientation.

FIG. 1C is the same as FIG. 1A for a different clamp orientation. The second end of detent 106 contacts the edge of weight bar 102 at a point along the neutral line at the same height as the end of palm plate and hook member 104. In this orientation weight W of weight bar 102 is supported by vertical force W/2 124 at the end of palm plate and hook member 104 and by vertical force W/2 122 at the contact point of detent 106. In fact, for any orientation of the clamp about weight bar center 100 the weight bar is constrained by palm plate and hook member 104 and detent 106. This is highly advantageous, as it permits a user to maintain a firm grasp on weight bar 102 with only a small lateral force preferably applied by the user's thumb. Thus, the user avoids any significant stress on fingers or thumb during weight lifting exercises.

Turning now to FIG. 2A, there is a side view of a first embodiment of a weight glove clamp of the present invention in a closed position. Palm plate 212 is connected to hook member 206 to constrain weight bar 102. In this orientation a user's palm is preferably facing upward with fingers wrapped around hook member 206. Slot 208 of palm plate 212 is arranged to receive a wrist strap, and slot 210 and slot 218 (218 not shown) are configured to receive a hand strap as will be explained in detail. Hinge 204 is connected to palm plate 212. Rotational point 108 is at the center of hinge 204. A first end of detent 106 is rotationally connected to hinge 204. A second end of detent 106 contacts the edge of weight bar 102 at a point near neutral line 112 to constrain the weight bar within hook member 206. Detent 106 may be slightly displaced from neutral line 112 as previously explained to provide a firm grip on bar 102. Detent 106 further includes thumb lever 202 to prevent the detent from closing below neutral line 112 in the closed position. Thumb lever 202 also facilitates opening and closing of the detent. Hook member 206, palm plate 212, and detent 106 may be also have a non-slip rubber coating as is known in the art to provide a firm grasp of weight bar 102 in the closed position.

FIG. 2B is a side view of the embodiment of FIG. 2A in an open position. From a closed position a user places the weight bar 102 in a stable position and releases thumb lever 202 to permit detent 106 and thumb lever 202 to rotate about rotational point 108. When the open position is attained weight bar 102 may be released from hook member 206.

FIG. 2C is a top view of the detent 106, thumb lever 202, and hinge 204 of FIG. 2A. Hinge regions 214 are connected to detent 106. Hinge regions 216 are connected to palm plate 212. Hinge regions 214 and 216 are held together rotationally by a central pin (not shown) of hinge 204. Thumb lever 202 is preferably a lateral extension of detent 106. This advantageously permits a user to hold detent 106 closed by grasping bar 102 in a natural position with the thumb and fingers. When the bar and weights are in a stable position on a surface with palm down the user's thumb may be removed from thumb lever 202 to permit detent 106 to open.

Figure 3A:
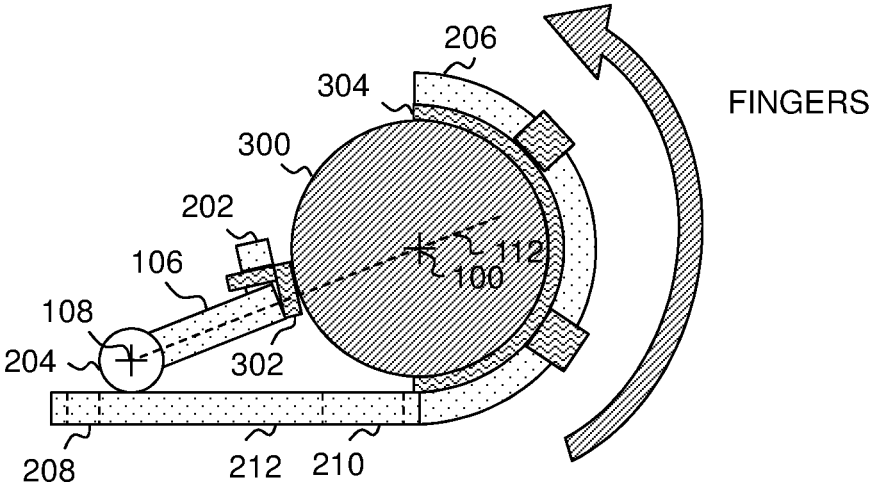
FIG. 3A is a side view of the weight glove clamp of FIG. 2A in the closed position with spacing attachments.

Referring now to FIG. 3A, there is a side view of the weight glove clamp of FIG. 2A in the closed position with spacing attachments. Recall that a barbell or dumbbell weight bar may vary in diameter from 29 mm to 35 mm in diameter. Of course it is possible to fabricate different size hook members and detents to fit each of the various weight bar diameters. The embodiment of FIG. 3A shows a weight bar 300 having a smaller diameter than weight bar 102 of FIG. 2A. A center 100 of weight bar 300 is held in the same position with respect to hook member 206 and detent 106 as weight bar 102 of FIG. 2A by spacers 302 and 304. These spacers are preferably a non-slip rubber material or any other suitable non-slip material as is known in the art. Spacer 304 is configured to slide over hook member 206, and spacer 302 is configured to slide over detent 106 and thumb lever 202. For example, if weight bar 102 (FIG. 2A) has a 35 mm diameter and weight bar 300 (FIG. 3A) has a 29 mm diameter, then each of spacers 302 and 304 are preferably 3 mm thick. Moreover, a family of spacers may be advantageously included with any embodiment of the weight glove clamp to adapt to any weight bar diameter between 29 mm and 35 mm.

Figure 3B:
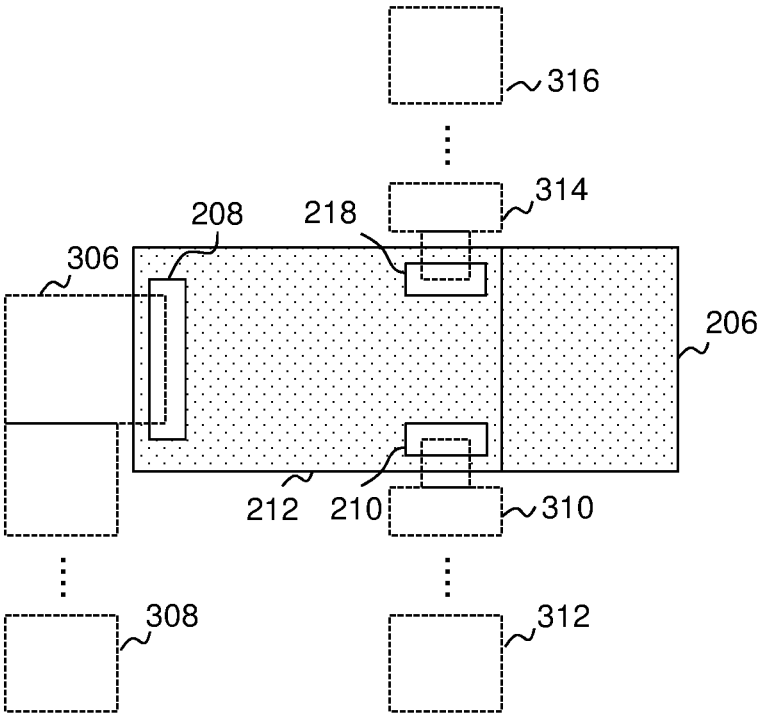
FIG. 3B is a top view of the weight glove clamp of FIG. 2A with straps attached and weight bar omitted for clarity.

Referring next to FIG. 3B, there is a top view of the weight glove clamp of FIG. 2A with straps attached. Weight bar 102 is omitted for clarity. Palm plate 212 has a flat portion and an extended portion forming a hook member 206. Palm plate 212 includes slot 208 coupled to wrist strap 306. An extended portion 308 of wrist strap 306 is arranged to wrap around a user's wrist to support the weight bar in the first orientation as in a starting position of a dead lift or military press. Extended portion 308 preferably includes a hook and loop fastener such as Velcro® to secure it to wrist strap 306. Other types of fasteners as are known in the art may also be used. Palm plate 212 also includes slots 210 and 218 coupled to respective hand straps 310 and 314. Each of hand straps 310 and 314 includes a respective extended portion 312 and 316 arranged to wrap around a user's hand to support the weight bar in the second, third, and fourth orientations. Extended portions 312 and 316 preferably include complementary hook and loop fasteners such as Velcro® to secure them to each other. Other types of fasteners as are known in the art may also be used.

Figure 4A:
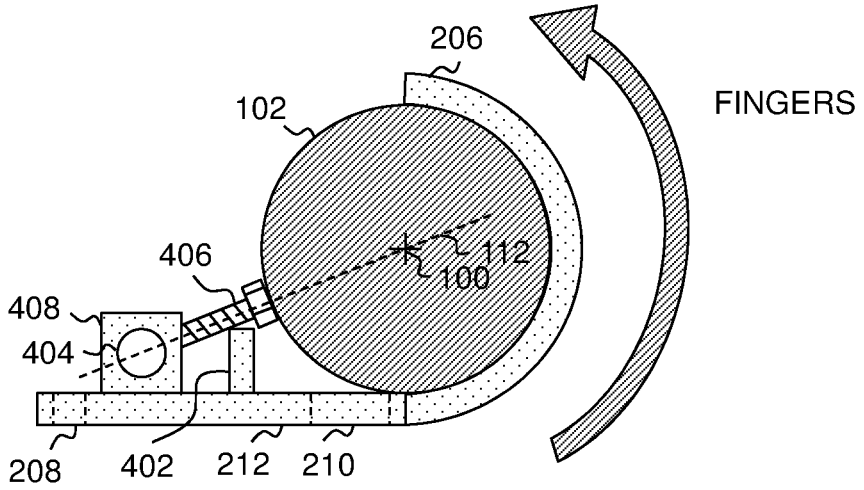
FIG. 4A is a side view of a second embodiment of a weight glove clamp of the present invention in a closed position.

FIG. 4A is a side view of a second embodiment of a weight glove clamp of the present invention in a closed position. Side plates 408 are connected to palm plate 212. Each side plate 408 includes a respective hole 404 configured to receive a nut (within hole 404) of barrel bolt 406. Thus, barrel bolt 406 is pivotally connected to palm plate 212 by attached side plates 408 and forms an adjustable detent. A head of barrel bolt 406 contacts the edge of weight bar 102 at a point along neutral line 112 to constrain the weight bar within hook member 206. Alternatively, the head of barrel bolt 406 may be slightly displaced from neutral line 112 as previously explained. Palm plate 212 further includes stop member 402 to prevent barrel bolt 406 from closing below neutral line 112 in the closed position. An optional thumb lever as described at FIG. 2A may be connected to the nut of barrel bolt 406 to facilitate opening and closing of the adjustable detent. Hook member 206, palm plate 212, and the head of barrel bolt 406 may be also have a non-slip rubber coating as is known in the art to provide a firm grasp of weight bar 102 in the closed position.

Figure 4B:
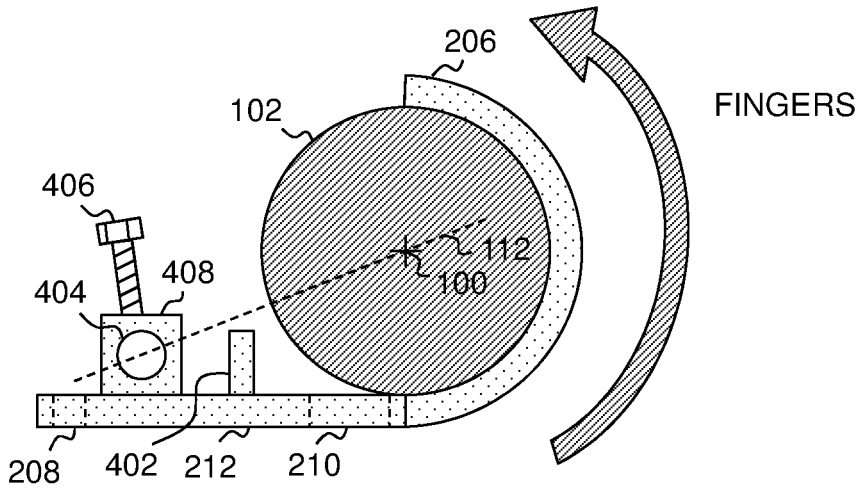
FIG. 4B is a side view of the embodiment of FIG. 4A in an open position.

FIG. 4B is a side view of the embodiment of FIG. 4A in an open position. From a closed position a user places the weight bar 102 in a stable position and removes thumb pressure from barrel bolt 406 or from an optional thumb lever to permit barrel bolt 406 to rotate with the barrel bolt nut. When the open position is attained weight bar 102 may be released from hook member 206.

Figure 5A:
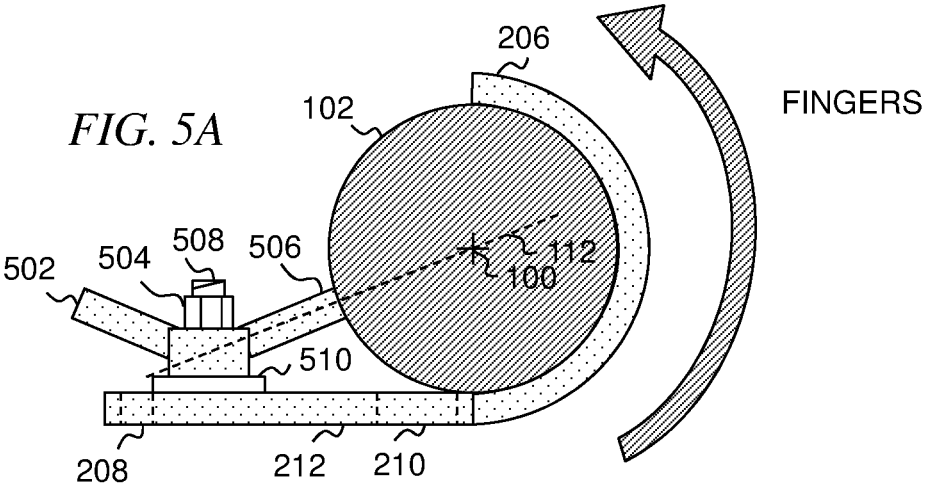
FIG. 5A is a side view of a third embodiment of a weight glove clamp of the present invention in a closed position.

FIG. 5A is a side view of a third embodiment of a weight glove clamp of the present invention in a closed position. A threaded stud 508 is connected in a perpendicular orientation to palm plate 212. An optional washer 510 and detent 506 are placed over threaded stud 508. A self-locking nut 504 is adjusted on threaded stud 508 to loosely constrain detent 506. In this configuration, detent 506 is free to rotate in a plane parallel to palm plate 212. In the closed position, detent 506 contacts the edge of weight bar 102 at a point along neutral line 112 to constrain the weight bar within hook member 206. Alternatively, detent 506 may contact the weight bar at a point slightly displaced from neutral line 112 as previously explained. Detent 506 may also include optional thumb lever 502 to facilitate opening and closing of the detent. Hook member 206, palm plate 212, and the end of detent 506 may be also have a non-slip rubber coating as is known in the art to provide a firm grasp of weight bar 102 in the closed position.

Figure 5B:
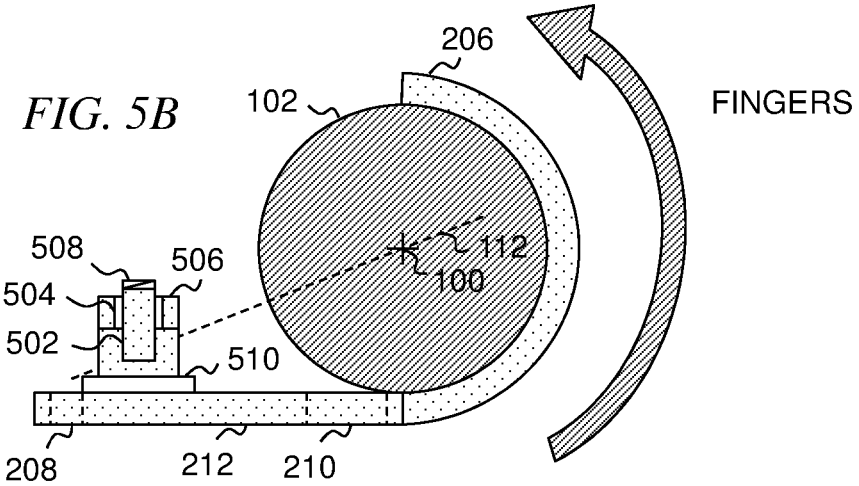
FIG. 5B is a side view of the embodiment of FIG. 5A in an open position.

FIG. 5B is a side view of the embodiment of FIG. 5A in an open position. From a closed position a user places the weight bar 102 in a stable position and applies sufficient pressure to thumb lever 502 to cause detent 506 to rotate about threaded stud 508 in a plane parallel to palm plate 212. When the open position is attained weight bar 102 may be released from hook member 206.

Figure 5C:
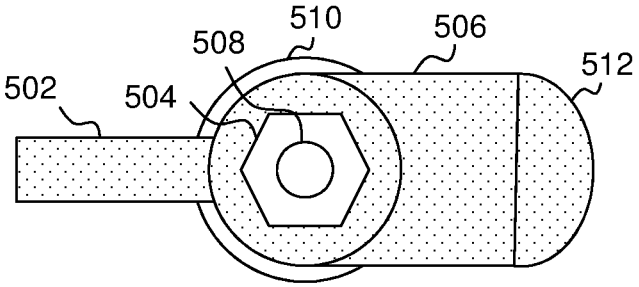
FIG. 5C is a top view of the detent of FIG. 5A.

FIG. 5C is a top view of detent 506 and optional thumb lever 502 over washer 510. Detent 506 is loosely secured on threaded stud 508 and against washer 510 by self-locking nut 504. An end of detent 506 includes a gradual ramp 512 to provide a secure grip of weight bar 102 in the closed position. Detent 506 may be advantageously replaced with different sizes of detents to accommodate different diameter weight bars. Alternatively, detent 506 may be fitted with different size spacers as previously discussed with reference to FIG. 3A.

Figure 6A:
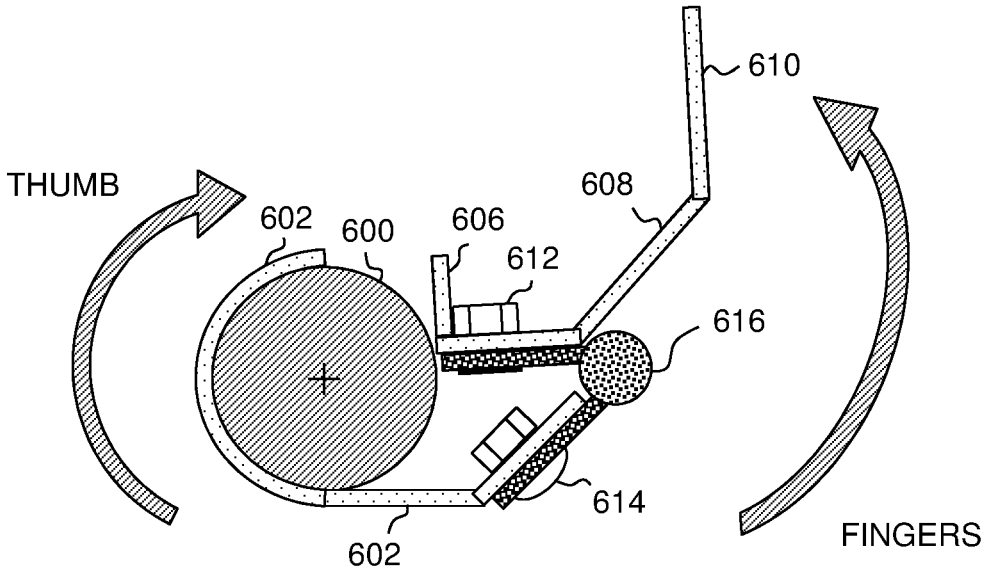
FIG. 6A is a side view of a fourth embodiment of a weight glove clamp of the present invention in a closed position.

FIG. 6A is a side view of a fourth embodiment of a weight glove clamp of the present invention in a closed position. A weight bar 600 may be a barbell, dumbbell, or other weight bar. Weight bar 600 is enclosed by hook member and palm plate 602 and by detent 606 in a closed position. Detent 606 includes extensions 608 and 610 to provide leverage for fingers to hold detent 606 in a closed position. Detent 606 is fastened to an upper plate of hinge 616 by flat head bolt and nut 612. A lower plate of hinge 616 is fastened to palm plate 602 by round head bolt and nut 614. In alternatively embodiments, detent 606 and palm plate 602 may be welded to respective hinge plates or even serve as hinge plates. Hand straps and wrist straps preferably attach the weight glove clamp to a weight lifter's hand as previously described. Thus, detent 606 is rotationally connected to palm plate 602 via hinge 616. Detent 606 may be moved to the open position to release weight bar 600 by clockwise rotation.

Figure 6B:
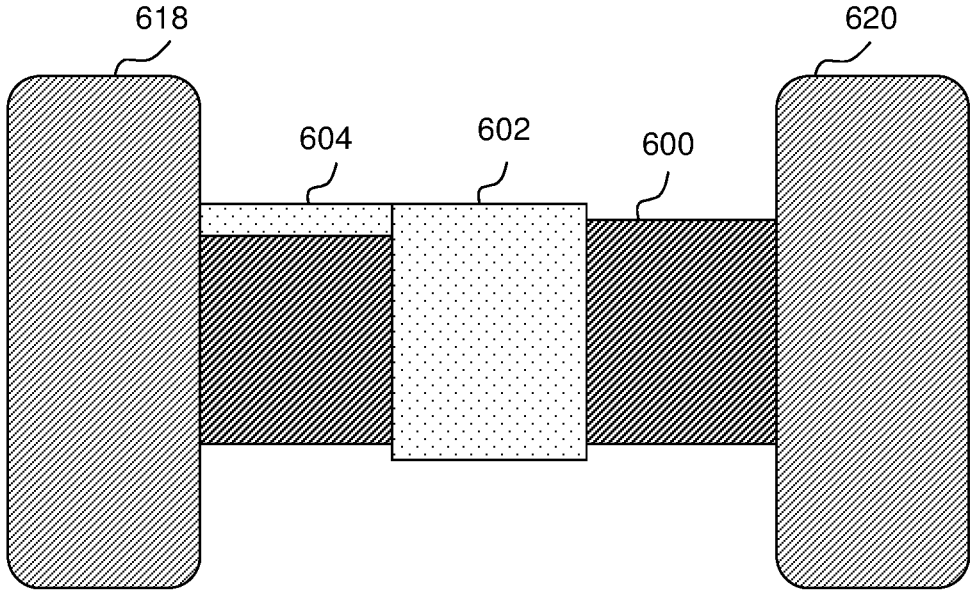
FIG. 6B is an end view of the embodiment of FIG. 6A with a dumbbell.

FIG. 6B is an end view of the embodiment of FIG. 6A with a dumbbell constrained in the closed position. The dumbbell bar 600 has an upper weight 618 and a lower weight 620 attached to opposite ends of the bar. Hook member 602 constrains dumbbell bar 600 in the closed position of detent 606 (FIG. 6A). A lateral spacer 604 is attached to hook member 602 and contacts upper weight 618. Upper weight 618 is typically on the same side as the thumb of a weight lifter's hand. The weight glove clamp of FIG. 6B, therefore, is preferably for the left hand. A corresponding lateral spacer for the right hand would preferably be on the opposite side of hook member 602 and would contact lower weight 620. In most exercises, dumbbell bar 600 will either be in a horizontal orientation as shown or tilted so that upper weight 618 is higher than lower weight 620. Lateral spacer 604, therefore, advantageously prevents lateral movement of the dumbbell within the weight glove clamp during exercises. Lateral spacer 604 may advantageously be used with any of the previously described embodiments to keep a dumbbell approximately centered with respect to the weight glove clamp.

Figure 7A:
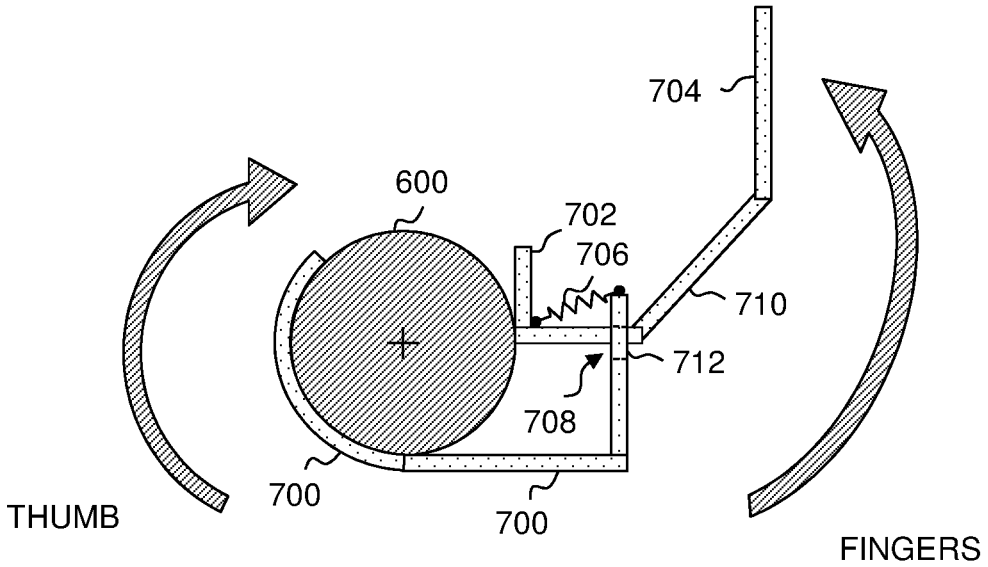
FIG. 7A is a side view of a fifth embodiment of a weight glove clamp of the present invention with a hinge in a closed position.

FIG. 7A is a side view of a fifth embodiment of a weight glove clamp of the present invention with a hinge 708 in a closed position. A weight bar 600 may be a barbell, dumbbell, or other weight bar. Weight bar 600 is enclosed by hook member and palm plate 700 and by detent 702 in a closed position. Detent 702 includes extensions 710 and 704 to provide leverage for fingers to hold detent 702 in a closed position. Detent 702 has a width greater than a width of extensions 710 and 704. Extended palm plate 700 includes a slot 712 having a width less than the width of detent 702 and slightly greater than the width of extensions 710 and 704. The weight glove clamp is assembled by sliding extensions 704 and 710 through slot 712 until the wider part of detent 702 abuts extended palm plate 700, thereby forming hinge 708. A small, optional spring 706 is fastened between detent 702 and extended palm plate 700. Spring 706 holds detent 702 against extended palm plate 700 during use and holds detent 702 in an open position when not in use. As with the embodiment of FIG. 6A, hand straps and wrist straps preferably attach the weight glove clamp to a weight lifter's hand as previously described. The embodiment of FIG. 7A may also include lateral spacer 604 of FIG. 6A. This embodiment of the present invention is highly advantageous for several reasons. First, it is compatible with other features of the previous embodiments such as the non-slip spacer FIG. 3A, adjustable detent FIG. 4A. Second, it only has two structural components and a spring. Finally, assembly is completed by sliding detent extensions 704 and 710 into slot 712 and attaching optional spring 706.

Figure 7B:
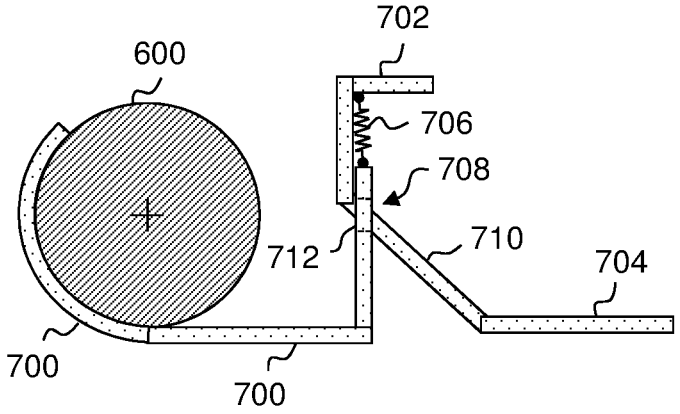
FIG. 7B is a side view of the embodiment of FIG. 7A in an open position.

FIG. 7B is a side view of the embodiment of FIG. 7A in an open position. When pressure of the fingers against extension 704 is removed, spring 706 causes detent 702 to rotate clockwise into an open position as shown. Then bar 600 is no longer held against hook member 700, and the weight is released.

Still further, while numerous examples have thus been provided, one skilled in the art should recognize that various modifications, substitutions, or alterations may be made to the described embodiments while still falling within the inventive scope as defined by the following claims. For example, the weight glove clamp may be fabricated from steel, aluminum, polyvinyl chloride, plastic, or any material having suitable rigidity. The weight glove clamp may be attached to a user's hand alone or over virtually any existing weight glove. Moreover, the weight glove clamp may also be used in other activities where a secure grip on a bar is desired. Other combinations will be readily apparent to one of ordinary skill in the art having access to the instant specification.

The invention claimed is:

1. An apparatus, comprising:

a palm plate connected to a hook member configured to receive a weight bar; and a detent rotationally connected to the palm plate and situated between the rotational connection and the weight bar to constrain the weight bar within the hook member in a closed position.

2. The apparatus of claim 1, further comprising a non-slip spacer configured to slip on one of the hook member and the detent.

3. The apparatus of claim 1, wherein the detent is configured to contact the weight bar in a closed position when aligned within 20 degrees of a neutral line extending from the rotational connection perpendicular to and through the center of the weight bar.

4. The apparatus of claim 1, comprising a thumb lever configured to open or close the detent.

5. The apparatus of claim 1, further comprising a lateral spacer configured to limit lateral movement of a weight within the apparatus.

6. The apparatus of claim 1, further comprising:

a first slot in the palm plate coupled to receive a wrist strap; and a second slot in the palm plate coupled to receive a hand strap.

7. An apparatus, comprising:

a palm plate connected to a hook member configured to receive a weight bar;

an adjustable detent rotationally connected to the palm plate and configured to constrain the weight bar within the hook member in a closed position; and a side plate connected to the palm plate and coupled to a rotating member, wherein the adjustable detent comprises a bolt threaded into the rotating member.

8. The apparatus of claim 7, further comprising a non-slip spacer arranged to slip on one of the hook member and the adjustable detent.

9. The apparatus of claim 7, wherein the adjustable detent is configured to contact the weight bar in a closed position when aligned within 20 degrees of a neutral line extending from the rotating member perpendicular to and through the center of the weight bar.

10. The apparatus of claim 7, further comprising a thumb lever configured to close and release the adjustable detent.

11. The apparatus of claim 7, further comprising a stop member configured to limit travel of the adjustable detent in the closed position.

12. The apparatus of claim 7, further comprising:

a first slot in the palm plate coupled to receive a wrist strap; and a second slot in the palm plate coupled to receive a hand strap.

13. An apparatus, comprising:

a palm plate connected to a hook member configured to receive a weight bar;

a detent connected to the palm plate and configured to rotate in a plane parallel to the palm plate to constrain the weight bar within the hook member in a closed position;

a threaded stud connected to the palm plate and rotationally coupled to the detent; and a self-locking nut threadedly coupled to the threaded stud to constrain the detent.

14. The apparatus of claim 13, further comprising a non-slip spacer arranged to slip on one of the hook member and the detent.

15. The apparatus of claim 13, wherein the detent is configured to contact the weight bar in a closed position when aligned within 20 degrees of a neutral line extending from the threaded stud perpendicular to and through the center of the weight bar.

16. The apparatus of claim 13, further comprising a thumb lever configured to open or close the detent.

17. The apparatus of claim 13, wherein an end of the detent is arranged to contact the weight bar and is configured as a ramp.

* * * * *